United States Patent [19]

Frommherz

[11] Patent Number: 4,650,162

[45] Date of Patent: Mar. 17, 1987

[54] WINCH HAVING A COMPACT HOUSING

[75] Inventor: Egon Frommherz, Steinen, Fed. Rep. of Germany

[73] Assignee: Rotzler GmbH & Co. Spezialfabrik für Seilwinden und Hebezeuge, Steinen, Fed. Rep. of Germany

[21] Appl. No.: 762,106

[22] Filed: Aug. 2, 1985

[30] Foreign Application Priority Data

Aug. 4, 1984 [DE] Fed. Rep. of Germany ..... 3428876

[51] Int. Cl.[4] ..... B66D 1/14; B66D 1/26

[52] U.S. Cl. ..... 254/309; 254/283; 254/371

[58] Field of Search ..... 254/214, 219, 278, 294, 254/295, 297, 344, 371, 369, 370, 355, 309, 283; 242/47.09, 155 BW

[56] References Cited

U.S. PATENT DOCUMENTS

| | | | |
|---|---|---|---|
| 2,372,026 | 3/1945 | Smith | 254/355 X |
| 2,497,603 | 2/1950 | Helstrom | 254/370 |
| 2,650,064 | 8/1953 | Picard | 254/370 X |
| 3,292,873 | 12/1966 | Tilloy | 242/47.09 |
| 3,931,958 | 1/1976 | Hobbs | 254/355 |
| 4,234,167 | 11/1980 | Lane | 254/295 X |
| 4,261,549 | 4/1981 | Bonassi | 254/344 X |
| 4,309,023 | 1/1982 | Plumettaz et al. | 254/299 X |
| 4,345,741 | 8/1982 | Rinio et al. | 254/371 X |

FOREIGN PATENT DOCUMENTS

| | | | |
|---|---|---|---|
| 34297 | 4/1907 | Austria | 254/295 |
| 1423139 | 1/1976 | United Kingdom | 254/369 |

*Primary Examiner*—Stuart S. Levy
*Assistant Examiner*—Joseph J. Hail, III
*Attorney, Agent, or Firm*—Walter Ottesen

[57] ABSTRACT

A winch is disclosed and is equipped with two drive shafts and two rope drums corresponding thereto. The rope drums have peripheral grooves in which the rope which is slung over the drums is guided. A slip clutch is provided to compensate for velocity differences in the region where the rope is slung over the rope drums. The slip clutch is associated with at least one of the two drive shafts of the rope drums.

4 Claims, 5 Drawing Figures

WINCH HAVING A COMPACT HOUSING

FIELD OF THE INVENTION

The invention relates to a winch with two drive shafts and two rope drums corresponding thereto. The rope drums have grooves formed in their peripheral surface for guiding the rope slung thereon.

BACKGROUND OF THE INVENTION

Known winches of this kind include a drive motor for driving the two rope drums via a corresponding branching transmission. A cable rope is slung over the rope drums. In this way, a rigid mechanical drive connection is obtained. When working with the winch, it is not possible to prevent the cable rope from becoming dirty. The dirt accumulates in the peripheral grooves of the rope drum guiding the rope. In this way, a layer of dirt builds up in the peripheral grooves and especially in the peripheral grooves of the rope drum over which the dirtied rope is first guided. The layer of dirt causes the diameter and the periphery of the rope drum to increase. The rotational speed of both, rope drums is the same and the layer of dirt causes the drums to have different peripheral velocities in accordance with the degree of dirt accumulation. The tangential velocities are transmitted to the rope cable slung about the rope drums. The different velocities introduce forces which are in part considerable and can cause the transmission to become prematurely damaged.

SUMMARY OF THE INVENTION

It is an object of the invention to provide a winch which achieves a substantially even force transmission in the region where the rope is slung over the rope drum. It is a further object of the invention to provide such a winch which achieves this compensation independently of the level to which the rope or rope drum has become dirty and which affords protection for the gearing.

The winch of the invention includes a frame housing; a first rope drum mounted in the housing; first drive shaft means mounted in the housing; a second rope drum mounted in the housing; second drive shaft means mounted in the housing; each one of the rope drums having guide grooves formed therein for guiding a rope slung about the rope drums; and, slip clutch means associated with at least the first drive shaft means.

Preferred embodiments of the invention as well as the advantages and essential details thereof are disclosed in the drawing and the description and the claims which follow.

BRIEF DESCRIPTION OF THE DRAWING

The invention will now be described with reference to the drawing wherein.

DESCRIPTION OF THE PREFERRED EMBODIMENTS OF THE INVENTION

Figure 1:
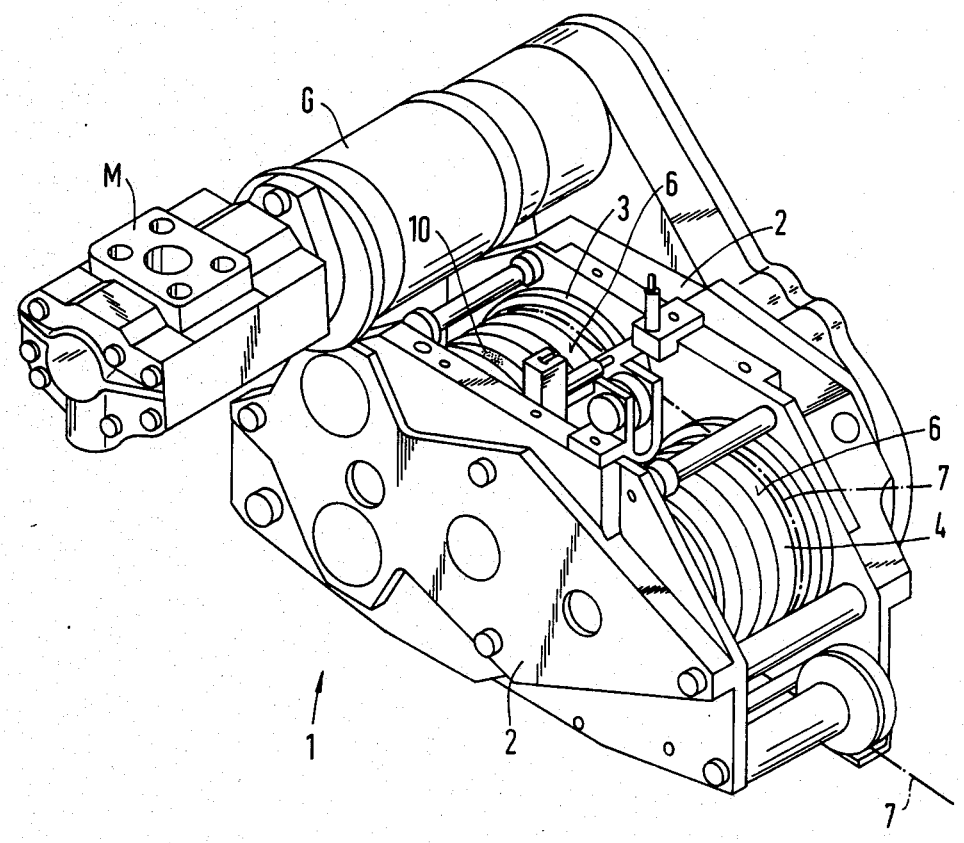
FIG. 1 is a perspective view of the winch according to the invention.

The winch 1 of FIG. 1 includes a frame housing 2 wherein two rope drums 3, 4 are rotatably journalled and are arranged so as to be mutually parallel and in spaced relationship to each other. The two rope drums 3, 4 are driven via a motor M, a corresponding branching gear transmission and drive shafts 5, 5' corresponding to respective ones of the rope drums 3, 4. The motor M is preferably an oil motor and the branching transmission is configured as a mechanically rigid gear transmission G. The rope drums 3, 4 have peripheral grooves 6 wherein the rope 7 is guided. The rope 7 is slung over both rope drums 3, 4. A load (not shown) is attachable to the rope 7.

Figure 3:
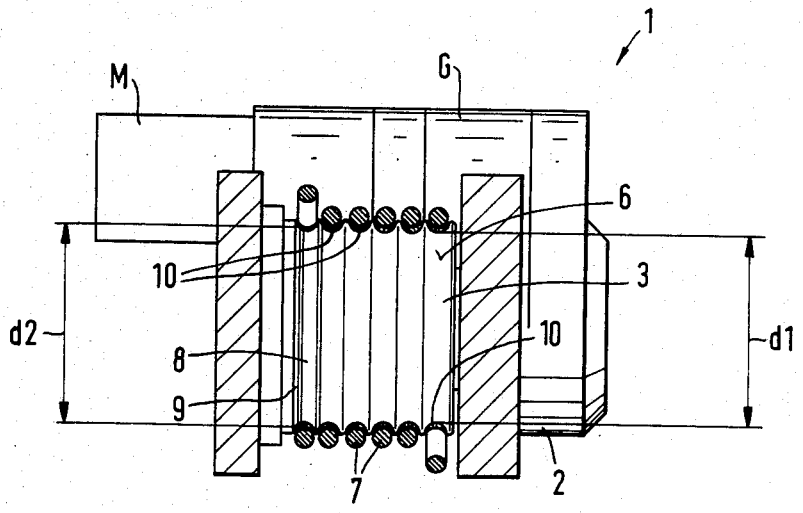
FIG. 3 is a section view taken along lines III—III of FIG. 2.
Figure 5:
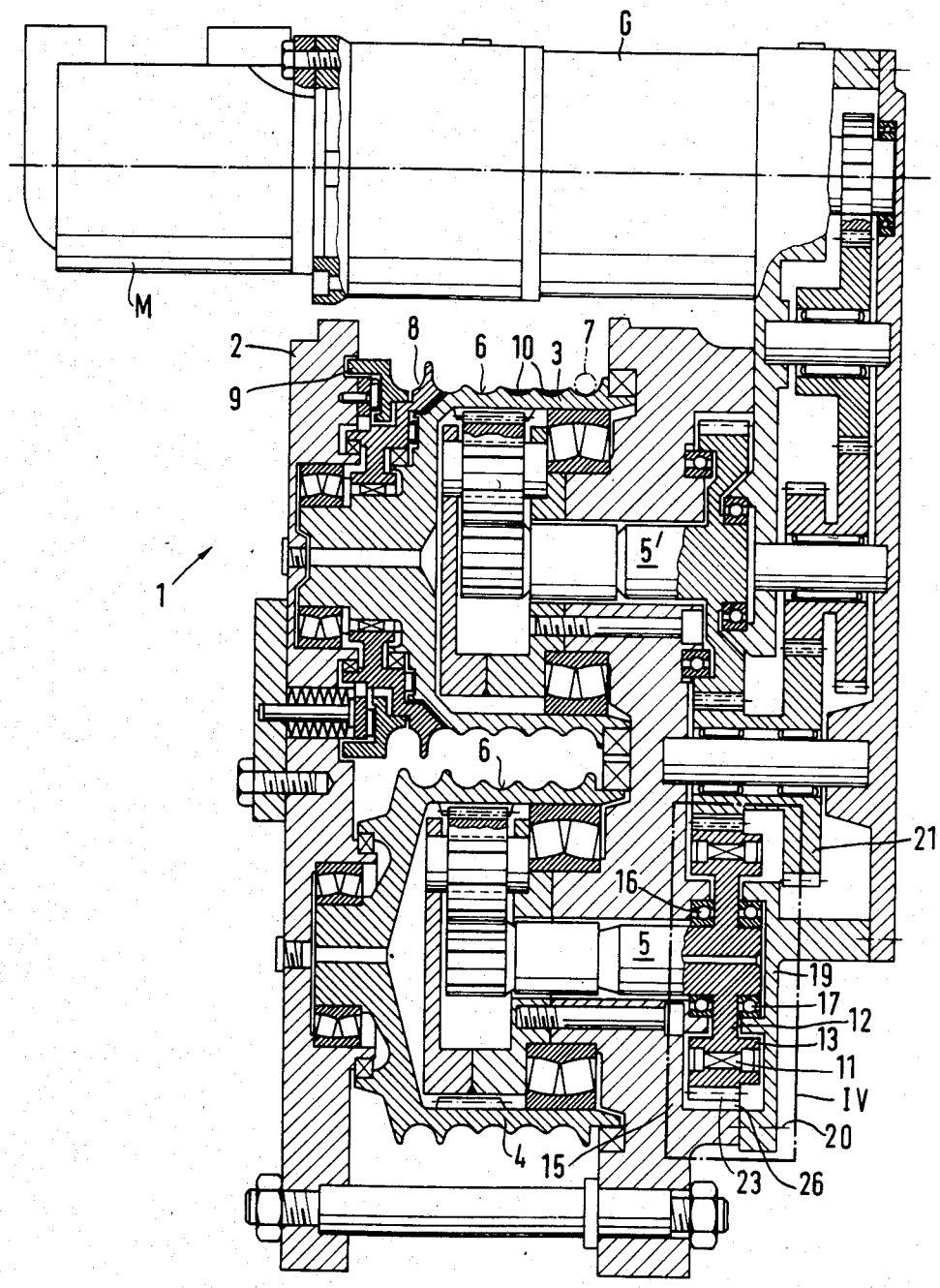

When the load is pulled, the rope 7 first runs on the rope drum 3 and leaves the winch 1 on the run-off groove 8 (FIG. 3) of the rope drum 3. This run-off groove 8 is configured so as to be divided and bounded by a tension disc 9 which is pressable against the side of rope 7 (FIG. 5).

When working with the winch 1, the rope 7 is often covered with mud or is otherwise dirty to the same extent. This dirt becomes seated in the peripheral grooves 6 when the rope 7 is pulled in and effects an increase of the rope drum diameter. Since the deposit of dirt 10 can be different, there are often corresponding diameter changes.

Figure 2:
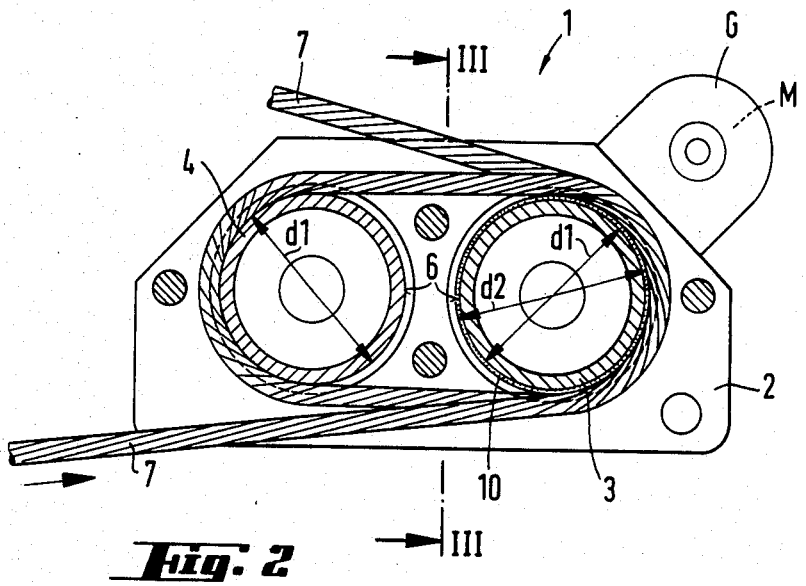
FIG. 2 is a side elevation view, partially in section, of the winch of FIG. 1.

FIG. 2 shows that when the peripheral grooves 6 are not impacted with dirt, diameter d1 of the rope drum 3 corresponds to the diameter d1 of rope drum 4. In contrast, if a layer of dirt 10 has built up in the peripheral grooves 6, the larger diameter d2 develops, for example, on the rope drum 3 and is greater than the diameter d1 of the rope drum 4 by an amount twice the thickness of the dirt layer 10. Accordingly, different peripheral velocities occur in the region of rope 7 whereat the latter is slung about the rope drums.

The conditions in the region of the winch 1 are different because the rope 7 becomes dirty. In order to compensate for these conditions, the winch according to the invention includes a slip clutch which in the present embodiment is preferably configured as an overrunning clutch 11 and is associated with the drive shaft 5 of the rope drum 4. It is within the concept of the invention to also associate the slip clutch or overrunning clutch with the drive shaft of the rope drum 3 or to both rope drums 3, 4.

Figure 4:
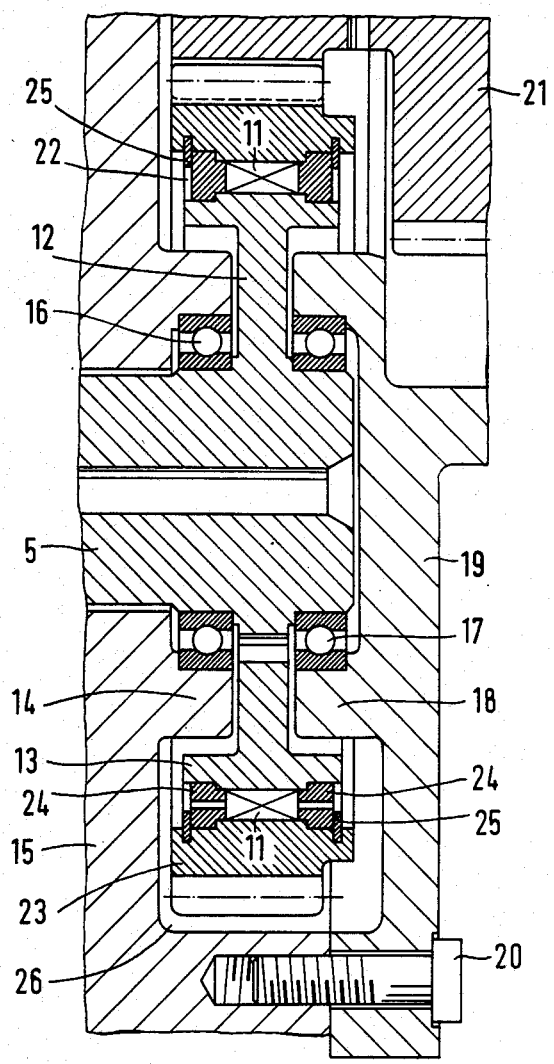
FIG. 4 is an enlarged section view of the region of the drive shaft bearing of a rope drum of the winch according to FIGS. 1 to 3; and, FIG. 5 is a horizontal section view taken though the winch of FIG. 1.

The drive shaft 5 includes a disc-shaped supporting portion 12 which has a wide annular shoulder 13 and has an approximately T-shaped configuration when viewed in cross section as shown in FIG. 4. An annular end flange 14 is disposed beneath the annular shoulder 13 and is located adjacent the supporting portion 12. The end flange 14 is formed on housing portion 15. The end flange 14 extends over and grasps a ball-bearing 16 located on the same side of the supporting portion 12. The drive shaft 5 in housing portion 15 is journalled by means of the bearing 16. The ball-bearing 16 is preferably configured as a so-called grooved bearing. A further ball-bearing 17 is located on the other side of the supporting portion 12 opposite the first-mentioned ball-bearing. Ball-bearing 17 is grasped by a supporting ring 18. The supporting ring 18 is configured on a gear case cover 19 which is tightly connected with the housing part 15 by means of a threaded fastener connection 20. A part of a wheel 21 having two sets of gear teeth formed thereon is shown in FIG. 4 and is located opposite the threaded fastener connection 20.

The slip clutch 11 is disposed in an annular gap 22 between the annular shoulder 13 and a gear ring 23. The gear ring 23 lies in the plane of the supporting portion 12 at a spacing above the annular shoulder 13 and its teeth mesh with the teeth of the gear wheel 21 having two sets of gear teeth. The annular gap 22 is closed at both sides by respective guide rings 24 and between which the slip coupling 11 is laterally journalled. The guide rings 24 are in turn held by means of snap rings 25 which are fitted into corresponding slots of the gear ring 23.

An annular chamber 26 is located in the region adjacent the threaded fastening 20 as shown in FIG. 4. The annular chamber 26 is defined in part by a recess formed in a portion of housing part 15 and a recess formed in transmission cover 19. The annular shoulder 13 of the drive shaft 5, the gear ring 23 and the slip clutch 11 mounted between the gear ring 23 and the annular shoulder 13 are all disposed inside the annular chamber 26.

With the arrangement of the slip clutch 11 of the winch according to the invention, the advantage is obtained that a compensation of the velocity differences occurring in the region where the rope is slung about the two rope drums 3, 4 is now independent of different degrees of dirt deposits so that the transmission and the remaining parts of the winch 1 which are subjected to a load are protected against unforeseen peak loads and a trouble-free operation is always assured.

In the embodiment of the invention disclosed herein, the slip for compensating for velocity difference is made possible by the slip coupling 11 exclusively when the rope 7 or load is pulled. However, it is also within the scope of the invention to configure the slip clutch so that a slip is possible in both directions and such a slip clutch can be configured as a laminar coupling or the like.

It is understood that the foregoing description is that of the preferred embodiments of the invention and that various changes and modifications may be made thereto without departing from the spirit and scope of the invention as defined in the appended claims.

What is claimed is:

1. A winch comprising:

a frame housing;

a first rope drum mounted in said housing;

first drive shaft means mounted in said housing;

a second rope drum mounted in said housing;

second drive shaft means mounted in said housing;

each one of said rope drums having guide grooves formed therein for guiding a rope slung about said rope drums;

slip clutch means associated with at least said first drive shaft means;

said first drive shaft means including a drive shaft defining a longitudinal axis and being rotatably mounted in said frame housing for rotatably driving said first rope drum, said drive shaft having an annular T-shaped flange extending radially therefrom to define a journalling surface facing radially outward from said shaft; the winch further including a ring gear disposed in surrounding relationship to said journalling surface so as to conjointly define an annular gap therewith; said slip clutch means being an overrunning clutch mounted in said annular gap;

a gear cover attached to said housing, said housing and said cover conjointly defining a T-shaped annular chamber for accommodating said ring gear, said overrunning clutch and said T-shaped flange therein;

said gear cover and said housing having respective annular projections formed thereon so as to be concentric with said axis and to define the stem portion of said T-shaped annular chamber;

said annular projections and said drive shaft conjointly defining respective bearing gaps adjacent the stem of said T-shaped flange so as to be disposed substantially radially inward of said journalling surface; and, two bearings mounted in respective ones of said bearing gaps for journalling said drive shaft in said housing and in said cover thereby providing an axially compact arrangement of said bearings and said overrunning clutch between said housing and said cover.

2. The winch of claim 1, said slip clutch means including two guide rings disposed in said annular gap on respective sides of said overrunning clutch.

3. The winch of claim 2, said slip clutch means further including two slots formed in said ring gear facing toward said journalling surface, and two snap rings mounted in corresponding ones of said slots for holding respective ones of said guide rings in place.

4. The winch of claim 1, said first and second rope drums being mounted parallel to each other in said housing, said second rope drum having an incoming rope groove and an outgoing rope groove formed thereon.

* * * * *